US008419600B1

(12) United States Patent
Danowski

(10) Patent No.: US 8,419,600 B1
(45) Date of Patent: Apr. 16, 2013

(54) RESISTANCE TRAINING EXERCISE APPARATUS WITH VACUUM LOAD SYSTEM

(75) Inventor: Thomas J. Danowski, Schaumburg, IL (US)

(73) Assignee: Brunswick Corporation, Lake Forest, IL (US)

( * ) Notice: Subject to any disclaimer, the term of this patent is extended or adjusted under 35 U.S.C. 154(b) by 393 days.

(21) Appl. No.: 12/854,279

(22) Filed: Aug. 11, 2010

(51) Int. Cl.
*A63B 21/008* (2006.01)

(52) U.S. Cl.
USPC ..... 482/112; 482/113

(58) Field of Classification Search ..... 482/110–111, 482/112–113, 137
See application file for complete search history.

(56) References Cited

U.S. PATENT DOCUMENTS 4,854,574 A 8/1989 Larson et al.
5,044,631 A 9/1991 Jones
5,147,263 A * 9/1992 Mueller ..... 482/112
5,346,452 A * 9/1994 Ku ..... 482/113
6,095,955 A * 8/2000 Lee ..... 482/112
6,468,190 B1 * 10/2002 Fazio et al. ..... 482/112
7,163,495 B2 * 1/2007 Fazio et al. ..... 482/112
7,517,306 B2 * 4/2009 Fisher et al. ..... 482/112
7,811,214 B1 * 10/2010 Danowski ..... 482/113
8,007,418 B2 * 8/2011 LeVert et al. ..... 482/112
2005/0059531 A1 * 3/2005 Collier ..... 482/44
2006/0160670 A1 * 7/2006 Spencer ..... 482/77
2011/0082018 A1 * 4/2011 Carnahan ..... 482/111

* cited by examiner

*Primary Examiner* — Stephen Crow

(74) *Attorney, Agent, or Firm* — Andrus, Sceales, Starke & Sawall, LLP

(57) ABSTRACT

Resistance training exercise apparatus includes a vacuum load system. Movement of a user-engaged exercise member in a first exercise direction pulls a piston in a cylinder to create vacuum in a housing chamber, which vacuum provides load resistance resisting exercise movement of the user-engaged exercise member.

18 Claims, 3 Drawing Sheets

RESISTANCE TRAINING EXERCISE APPARATUS WITH VACUUM LOAD SYSTEM

BACKGROUND AND SUMMARY

The invention relates to resistance training exercise apparatus.

Various types of resistance training exercise apparatus are known in the prior art, including load systems for providing resistance, including weight stacks, and air pressure.

The present invention arose during continuing development efforts in the above technology.

DETAILED DESCRIPTION

Figure 1:
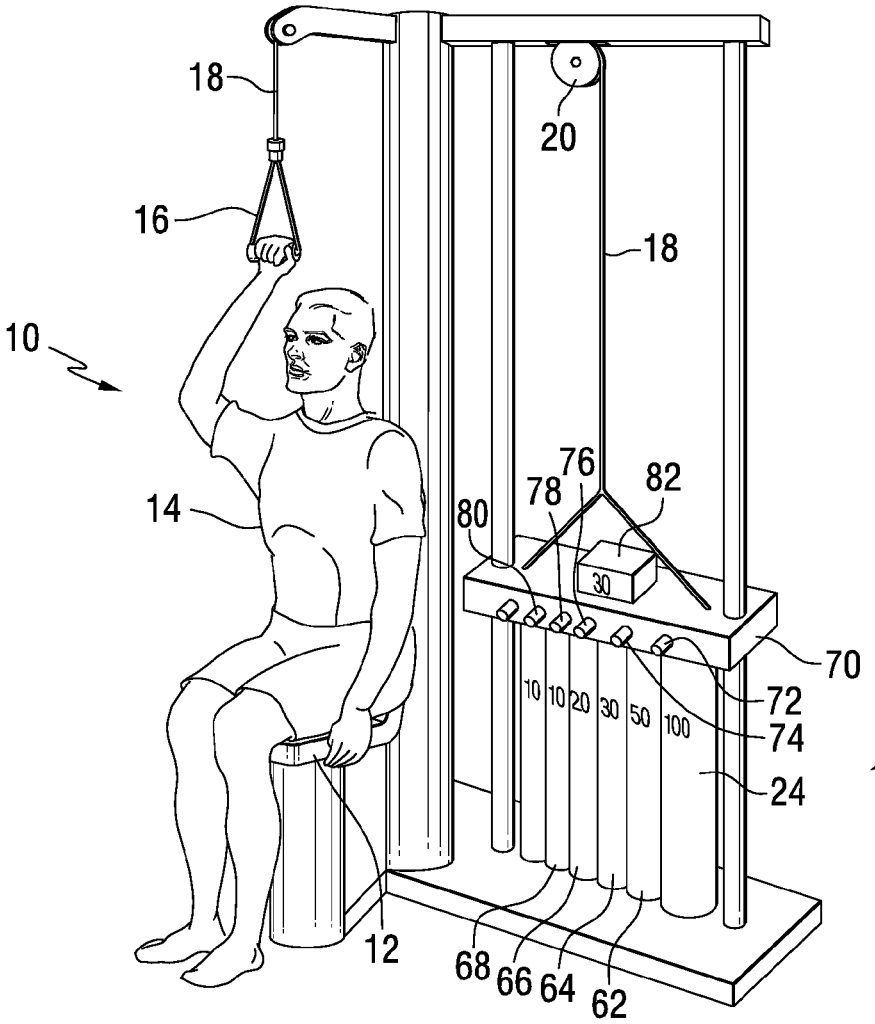
FIG. 1 is a perspective view of resistance training exercise apparatus in accordance with the invention.

FIG. 1 shows resistance training exercise apparatus 10 including a seat 12 for supporting a seated user 14 and having a handle 16 for gripping by the user and connected through a cable 18 and pulley system 20 to a load system for providing resistance, as is known.

Figure 2:
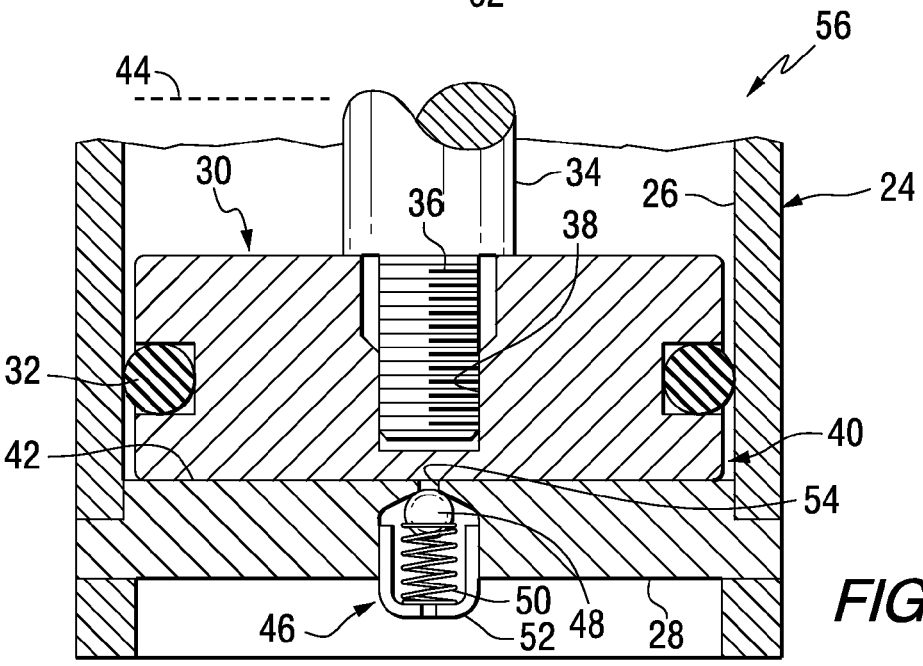
FIG. 2 is a sectional view of a portion of FIG. 1.
Figure 3:
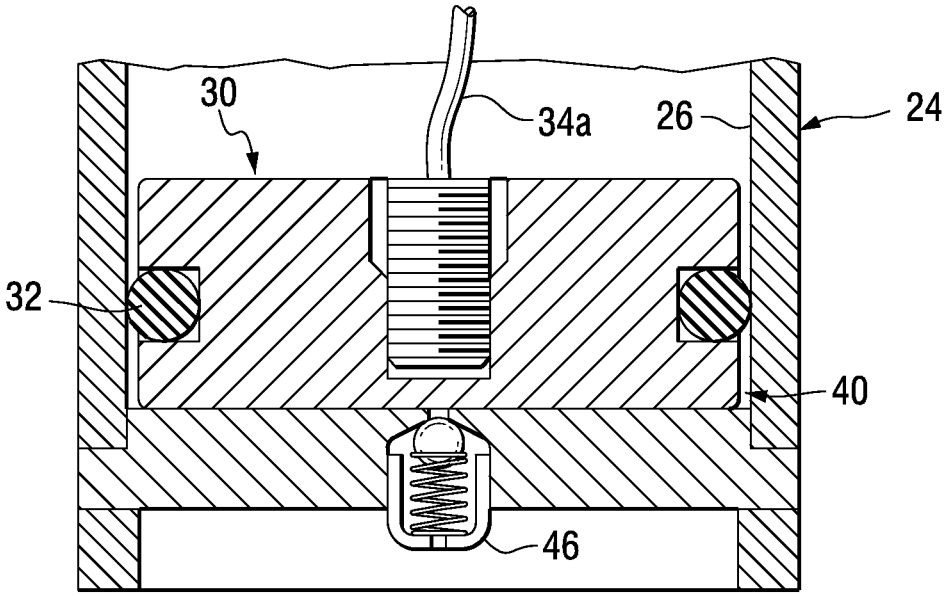
FIG. 3 is like FIG. 2 and shows another embodiment.

The present system provides a load system 22 including an axially extending tubular housing 24, FIGS. 1, 2, having an inner cylinder wall 26 extending axially from an axial end wall 28. A piston 30 in the housing engages cylinder wall 26 in sealing relation and is axially slidable therealong, e.g. up-down in FIG. 2. An O-ring 32 may provide a seal, or other types of rings may be used or multiple rings may be used or a cup seal may be provided on each side of the piston or in another embodiment no sealing ring or gasket is used and instead a flush fit between the piston and the cylinder wall is relied upon for sealing purposes. A connector link 34, e.g. a rigid piston rod or other rod or a flexible cable 34*a*, FIG. 3, extends from piston 30 and is coupled to user-engaged exercise member 16, e.g. through the noted cable and pulley system 18, 20. Rod 34 is secured to piston 30 in any suitable manner, e.g. by being threaded thereinto as shown at threads 36 of rod 34 threaded into threaded bore 38 of piston 30. Piston 30 defines a chamber 40 in housing 24 between piston 30 and end wall 28. FIG. 2 shows the volume of such chamber 40 being at a minimum, in one embodiment substantially zero, with piston 30 touching end wall 28. Though the noted volume will never be perfectly zero, because there is always some volume at 40, the noted one embodiment provides substantially zero volume to minimize the relative amount of free space that will need to be expanded to create vacuum. Piston 30 is movable in a first axial direction (upwardly in FIG. 2) away from end wall 28 to increase the volume of chamber 40, whereafter piston 30 is movable in a second opposite axial direction (downwardly in FIG. 2) toward end wall 28 to decrease the volume of chamber 40. Movement of piston 30 in the noted first axial direction (upwardly in FIG. 2) creates vacuum in chamber 40. This vacuum provides load resistance resisting exercise movement of user-engaged exercise member 16, e.g. resisting downward and/or outward leftward movement of member 16 in FIG. 1.

Piston 30 has an axial travel stroke (up-down in FIG. 2) between a rest position as shown in solid line at 42, and a loaded position as shown in dashed line at 44. Piston 30 moves in the noted first axial direction (upwardly) from the rest position to the loaded position and is resisted by vacuum load resistance due to the vacuum created in chamber 40. Such vacuum urges piston 30 to move in a second axial direction (downwardly in FIG. 2) to return to the rest position from the loaded position. Housing 24 is open to atmosphere at its top, and accordingly atmospheric pressure is applied to the upper surface of piston 30, while vacuum is applied to the lower surface of piston 30 upon upward movement of the piston as pulled upwardly by rod 34 coupled to cable 18. In one embodiment, chamber 40 is selected to minimize the volume of such chamber when piston 30 is in its lowered rest position, to minimize the relative amount of free space that will need to be expanded to create the noted vacuum. Further in such embodiment, the volume of chamber 40 is substantially zero when piston 30 is in its rest position 42.

In one embodiment, chamber 40 has a one-way valve 46, FIG. 2, blocking ingress of air into chamber 40 and permitting egress of air from chamber 40. This accommodates leakage of air past piston 30 into chamber 40 and permits expulsion of such leakage air from chamber 40 downwardly through valve 46 upon downward movement of piston 30 in the noted second axial direction (downwardly in FIG. 2). This facilitates movement of piston 30 to its rest position at 42 and maintains minimized free space in chamber 40 that will need to be expanded to create the noted vacuum. One-way valve 46 may be a check valve having a ball 48 biased by spring 50 bearing against cage 52 and biasing ball 48 upwardly against valve seat 54.

User-engaged exercise member 16 is movable in at least two opposite exercise directions, e.g. downwardly and upwardly in FIG. 1. Load system 22 provides load in both directions of exercise movement of user-engaged exercise member 16. Load system 22 provides load in a first direction of exercise movement of user-engaged exercise member 16 (e.g. downwardly in FIG. 1) corresponding to the noted first direction of piston movement (upwardly in FIG. 2). Load system 22 provides load in a second opposite direction of exercise movement of user-engaged exercise member 16 (e.g. upwardly in FIG. 1) corresponding to the noted second direction of piston movement (downwardly in FIG. 2). Vacuum load 22 thus simulates a weight stack relying upon gravity to provide load in both directions of exercise movement of user-engaged exercise member 16. The first direction of exercise movement of user-engaged exercise member 16 (downwardly in FIG. 1) applies a first direction force on piston 30 (an upwardly directed pulling force in FIG. 2) which is resisted by the noted vacuum created in chamber 40. The noted vacuum applies a second opposite direction force on piston 30 (a downwardly directed force in FIG. 2) urging piston 30 to return to its rest position at 42 and urging user-engaged exercise member 16 in the noted second opposite direction of movement thereof (upwardly in FIG. 1).

Figure 4:
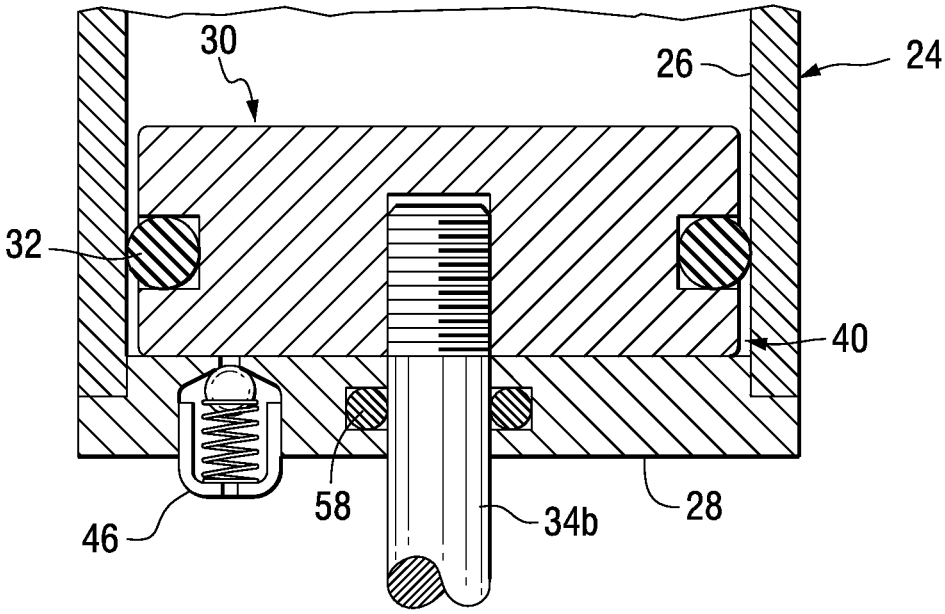
FIG. 4 is like FIG. 2 and shows another embodiment.

In the embodiment of FIG. 2, rod 34 is axially extensible out of and retractable into housing 24 at an axial end 56 of the housing distally opposite end wall 28. In another embodiment, rod 34*b*, FIG. 4, extends axially through end wall 28 and is axially extensible out of and retractable into the housing at end wall 28 in axial sealing sliding relation, and may include a sealing O-ring 58.

In further embodiments, the load system includes a plurality of axially extending tubular housings as shown in FIG. 1 at 24, 62, 64, 66, 68, and so on, each housing having an inner cylinder wall, e.g. 26, FIG. 2, extending axially from an axial end wall 28. A plurality of pistons such as 30 are provided, one in each of the noted housings and engaging a respective cylinder wall in sealing relation and axially slidable therealong. A plurality of connector links such as 34 are provided, each extending from a respective piston 30 and couplable to a user-engaged exercise member 16 through a coupler bar 70 and the noted cable and pulley system 18, 20. Each piston defines a chamber such as 40 in its respective housing between the respective piston 30 and the respective end wall 28, as above. Each piston is movable in a first axial direction (e.g. upwardly in FIG. 2) away from the respective end wall 28 to increase the volume of the respective chamber 40. Each piston is movable in a second opposite axial direction (downwardly in FIG. 2) toward the respective end wall 28 to decrease the volume of the respective chamber 40. Movement of each piston in the noted first axial direction (upwardly in FIG. 2) creates vacuum in the respective chamber 40 of the respective housing, which vacuum provides load resistance resisting movement of the coupled user-engaged exercise member 16 coupled through coupler bar 70 to the respective connector link provided by rod 34. A plurality of push-pull pins such as 72, 74, 76, 78, 80 and so on, are provided, one for each of the noted rods such as 34. Each push-pull pin is user-actuatable, e.g. by pushing in or pulling out, to engage and disengage a respective rod 34 to select which rods are coupled to coupler bar 70. The cumulative vacuum load is determined by the number of rods engaged and coupled to coupler bar 70.

In various embodiments, the plurality of the noted housings include a subset of a plurality of housings providing different vacuum loads, e.g. housing 24 providing a 100 lb. vacuum load, housing 62 providing a 50 lb. vacuum load, housing 68 providing a 10 lb. vacuum load, and so on. Also in various embodiments, the plurality of noted housings includes another subset of a plurality of housings providing the same vacuum load, e.g. housing 64 providing a 20 lb. vacuum load and housing 66 providing a 20 lb. vacuum load. This offers the user selectivity in choosing the load desired by simply engaging or disengaging the rod 34 of a selected housing at the respective push-pull pin. In various embodiments, the push-pull pins may have magnets on their ends which can interact with Hall effect sensors or switches in a circuit which adds the cumulative load selected and then displays the total load on a display such as a liquid crystal display 82. In further embodiments, such circuit may be powered by a solar cell.

In one embodiment, a 100 lb. load housing is provided by its piston 30 having an area of 6.80 sq. in., a radius 1.47 in., and a diameter of 2.94 in., and a 50 lb. load housing is provided by its piston 30 having an area of 3.40 sq. in., a radius of 1.04 in., and a diameter of 2.08 in., and a 20 lb. load housing is provided by its piston 30 having an area of 1.36 sq. in., a radius of 0.65 in., and a diameter of 1.131 in., and a 10 lb. load housing is provided by its piston having an area of 0.68 sq. in., a radius of 0.46 in., and a diameter of 0.93 in. Further in various embodiments, the system enables low overall pressure requirements such as 15 lb. per sq. in. maximum, and accordingly the housings such as 24 may be manufactured using plastic or other low cost material, including for cylinder walls 26.

Figure 5:
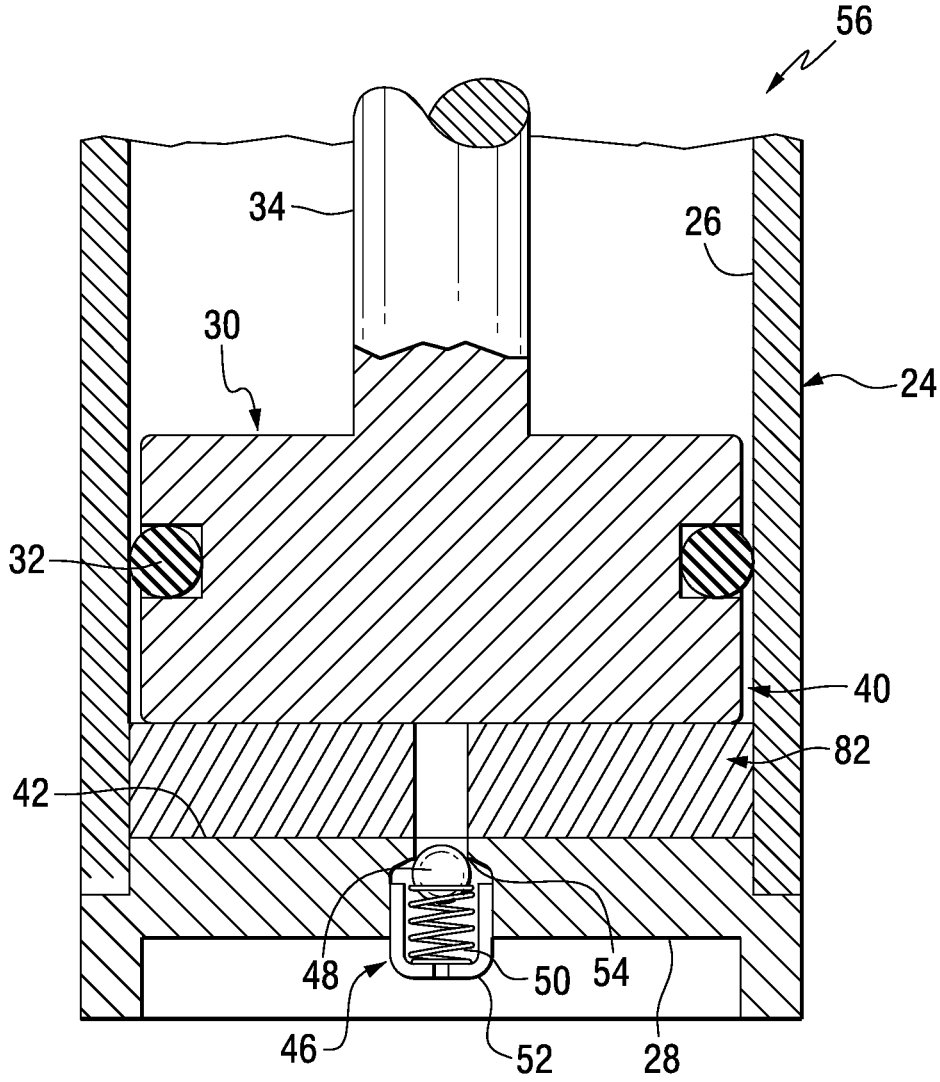
FIG. 5 is like FIG. 2 and shows another embodiment.

FIG. 5 shows another embodiment and uses like reference numerals from above where appropriate to facilitate understanding. A bumper member 82 is provided in housing 24 and is disposed axially between piston 30 and end wall 28. Bumper member 82 dampens impact of piston 30 against end wall 28 upon movement of the piston in the noted second axial direction (downwardly in FIGS. 2, 5). This prevents the piston from smashing into the end wall should the load be released by user 14, which may otherwise allow the piston to slam back downwardly against end wall 28. The bumper dampens the impact of such piston movement should the user let go of the load. In one embodiment, bumper member 82 is composed of resilient material, e.g. rubber.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. Resistance training exercise apparatus comprising a load system for providing resistance comprising an axially extending tubular housing having an inner cylinder wall extending axially from an axial end wall, a piston in said housing and engaging said cylinder wall in sealing relation and axially slidable therealong, a connector link extending from said piston and coupled to a user-engaged exercise member, said piston defining a vacuum load chamber in said housing between said piston and said end wall, said piston moving in a first axial direction away from said end wall to increase the volume of said vacuum load chamber, said piston moving in a second opposite axial direction toward said end wall to decrease the volume of said vacuum load chamber, wherein movement of said piston in said first axial direction creates vacuum in said vacuum load chamber, which vacuum provides load resistance resisting exercise movement of said user-engaged exercise member, wherein said piston has an axial travel stroke between a rest position and a loaded position, wherein said piston moves in said first axial direction from said rest position to said loaded position and is resisted by vacuum load resistance due to said vacuum created in said vacuum load chamber, wherein said vacuum urges said piston to move in a second axial direction to return to said rest position from said loaded position, wherein said vacuum load chamber has a one-way valve blocking ingress of air into said vacuum load chamber and permitting egress of air from said vacuum load chamber, whereby to accommodate leakage of air past said piston into said vacuum load chamber and permit expulsion of such leakage air from said vacuum load chamber upon movement of said piston in said second axial direction, to facilitate movement of said piston to said rest position.

2. The resistance training exercise apparatus according to claim 1 wherein said user-engaged exercise member is movable in two opposite directions, and wherein said load system provides load in both said directions of exercise movement of said user-engaged exercise member.

3. The resistance training exercise apparatus according to claim 2 wherein said load system provides load in a first direction of exercise movement of said user-engaged exercise member corresponding to said first direction of piston movement, and said load system provides load in a second opposite direction of exercise movement of said user-engaged exercise member corresponding to said second direction of piston movement.

4. The resistance training exercise apparatus according to claim 3 wherein said first direction of exercise movement of said user-engaged exercise member applies a first direction force on said piston which is resisted by said vacuum, and wherein said vacuum applies a second opposite direction force on said piston urging said piston to return to said rest position and urging said user-engaged exercise member in said second opposite direction of movement thereof.

5. The resistance training exercise apparatus according to claim 1 wherein said connector link comprises a rod.

6. The resistance training exercise apparatus according to claim 5 wherein said rod is axially extensible out of and retractable into said housing at an axial end of said housing distally opposite said end wall.

7. The resistance training exercise apparatus according to claim 5 wherein said rod extends axially through said end wall and is axially extensible out of and retractable into said housing at said end wall.

8. The resistance training exercise apparatus according to claim 1 wherein said connector link comprises a flexible cable.

9. The resistance training apparatus according to claim 1 comprising a bumper member in said housing, said bumper member being disposed axially between said piston and said end wall and dampening impact of said piston against said end wall upon said movement of said piston in said second axial direction.

10. The resistance training apparatus according to claim 9 wherein said bumper member is composed of resilient material.

11. Resistance training exercise apparatus comprising a load system for providing load resistance comprising a plurality of axially extending tubular housings each having an inner cylinder wall extending axially from an axial end wall, a plurality of pistons, one in each of said housings and engaging a respective said cylinder wall in sealing relation and axially slidable therealong, a plurality of connector links each extending from a respective said piston and couplable to a user-engaged exercise member through a coupler bar, each said piston defining a vacuum load chamber in a respective said housing between the respective said piston and the respective said end wall, each said piston moving in a first axial direction away from the respective said end wall to increase the volume of the respective said vacuum load vacuum load chamber, each said piston moving in a second opposite axial direction toward the respective said end wall to decrease the volume of the respective said vacuum load vacuum load chamber, wherein movement of each said piston in said first axial direction creates vacuum in the respective said vacuum load vacuum load chamber of the respective said housing, which vacuum provides load resistance resisting exercise movement of the coupled said user-engaged exercise member coupled through said coupler bar to the respective said connector link, wherein each said connector link comprises a rod, and comprising a plurality of push-pull pins, one for each of said rods, and user-actuatable to engage and disengage a respective said rod to select which rods are coupled to said coupler bar, wherein the cumulative vacuum load is determined by the number of rods engaged and coupled to said coupler bar.

12. The resistance training exercise apparatus according to claim 11 wherein said plurality of housings include a first housing providing a first vacuum load, and a second housing providing a second vacuum load, wherein said first and second vacuum loads are different.

13. The resistance training exercise apparatus according to claim 11 wherein said plurality of housings include a first housing providing a first vacuum load, and a second housing providing a second vacuum load, wherein said first and second vacuum loads are the same.

14. The resistance training exercise apparatus according to claim 11 wherein said plurality of pistons have areas transverse to axial movement, wherein said areas range from 0.68 sq. in. to 6.80 sq. in.

15. The resistance training exercise apparatus according to claim 11 wherein said housings including said cylinder walls are composed of plastic material.

16. The resistance training apparatus according to claim 11 comprising at least one bumper member in at least one of said housings, said one bumper member being disposed axially between the respective said piston and the respective said end wall and dampening impact of said respective piston against said respective end wall upon movement of said respective piston in said second axial direction.

17. Resistance training exercise apparatus comprising a load system for providing resistance comprising a vacuum load assembly comprising an axially extending tubular housing having an inner cylinder wall extending axially from an axial end wall, a piston in said housing and engaging said cylinder wall in sealing relation and axially slidable therealong, a connector link extending from said vacuum load assembly and coupled to a user-engaged exercise member, said piston defining a vacuum load chamber in said housing between said piston and said end wall, said piston moving in a first axial direction away from said end wall to increase the volume of said vacuum load chamber, said piston moving in a second opposite axial direction toward said end wall to decrease the volume of said vacuum load chamber, wherein movement of said piston in said first axial direction creates vacuum in said vacuum load chamber, which vacuum provides load resistance resisting exercise movement of said user-engaged exercise member, wherein said piston has an axial travel stroke between a rest position and a loaded position, wherein said piston moves in said first axial direction from said rest position to said loaded position and is resisted by vacuum load resistance due to said vacuum created in said vacuum load chamber, wherein said piston in said rest position engages said axial end wall such that the volume of said vacuum load chamber is substantially zero when said piston is in said rest position, wherein said vacuum load chamber has a one-way valve blocking ingress of air into said vacuum load chamber and permitting egress of air from said vacuum load chamber, whereby to accommodate leakage of air past said piston into said vacuum load chamber and permit expulsion of such leakage air from said vacuum load chamber upon movement of said piston in said second axial direction, to enable said piston to return to said rest position engaging said axial end wall and providing said substantially zero volume of said vacuum load chamber.

18. The resistance training exercise apparatus according to claim 17 wherein said user-engaged exercise member is movable in two opposite directions, and wherein said load system provides load in both said directions of exercise movement of said user-engaged exercise member, said load system provides load in a first direction of exercise movement of said user-engaged exercise member corresponding to said first direction of piston movement, and said load system provides load in a second opposite direction of exercise movement of said user-engaged exercise member corresponding to said second direction of piston movement, said first direction of exercise movement of said user-engaged exercise member applies a first direction force on said piston which is resisted by said vacuum, and wherein said vacuum applies a second opposite direction force on said piston urging said piston to return to said rest position and urging said user-engaged exercise member in said second opposite direction of movement thereof.

* * * * *